United States Patent [19]

Wick et al.

[11] 3,988,756

[45] Oct. 26, 1976

[54] APPARATUS FOR PROCESSING WEBS OF PHOTOGRAPHIC MATERIAL

[75] Inventors: Richard Wick, Munich; Josef Pfeifer; Helmut Schausberger, both of Unterhaching, all of Germany

[73] Assignee: AGFA-Gevaert, A.G., Leverkusen, Germany

[22] Filed: Jan. 28, 1975

[21] Appl. No.: 544,779

[30] Foreign Application Priority Data

Jan. 29, 1974 Germany ..... 2403984

[52] U.S. Cl. ..... 354/319; 134/122 P; 354/324

[51] Int. Cl.[2] ..... G03D 3/08

[58] Field of Search ..... 354/297, 319, 320, 321, 354/322, 324; 134/64 P, 122 P

[56] References Cited

UNITED STATES PATENTS

| | | | |
|---|---|---|---|
| 3,060,829 | 10/1962 | Leighton et al. | 354/321 X |
| 3,097,584 | 7/1963 | Wright | 354/319 X |
| 3,641,911 | 2/1972 | Aelterman et al. | 134/64 P |
| 3,688,677 | 9/1972 | Frick et al. | 134/122 P |
| 3,873,988 | 3/1975 | Pfeifer et al. | 354/319 |

*Primary Examiner*—Fred L. Braun
*Attorney, Agent, or Firm*—Michael J. Striker

[57] ABSTRACT

Apparatus for wet treatment of webs of photographic material has a series of chambers each of which defines an upper and a lower horizontal path for the transport of webs therethrough and a discrete liquid collecting tank below each chamber. Each chamber has an upper section above the upper path, a median section between the two paths and a lower section below the lower path, and each section has an inlet which receives liquid from the tank through the medium of a pump and an upright pipe which latter can constitute a support for the respective chamber. The liquid which issues from the inlet of the median section of a chamber is divided into two streams which respectively contact the undersides and upper sides of webs in the upper and lower paths. The upper sides of webs in the upper path are contacted by liquid issuing from the inlet of the upper section, and the undersides of webs in the lower path are contacted by liquid issuing from the inlet of the lower section. Each chamber allows the liquid to escape therefrom by flowing in and counter to the direction of transport of the webs, and such liquid is intercepted by guide members which direct the intercepted liquid into vertical ducts serving to return the liquid into the tank. The ducts are adjacent to the sides of the upper and lower paths and prevent the descending liquid from contacting the surrounding atmosphere.

10 Claims, 2 Drawing Figures

APPARATUS FOR PROCESSING WEBS OF PHOTOGRAPHIC MATERIAL

CROSS-REFERENCE TO RELATED INVENTIONS

The apparatus of the present invention constitutes an improvement over and a further development of apparatus disclosed in commonly owned U.S. Pat. No. 3,688,677, granted Sept. 5, 1972, to Frick et al. and in commonly owned copending application Ser. No. 433,444 filed Jan. 15, 1974, now U.S. Pat. No. 3,873,988, by Pfeifer et al.

BACKGROUND OF THE INVENTION

The present invention relates to apparatus for processing webs or sheets of photographic material, and more particularly to improvements in apparatus of the type disclosed in the copending application Ser. No. 433,444 of Pfeifer et al. The application of Pfeifer et al. discloses an apparatus for simultaneous treatment of two series of successive webs of photographic material wherein a frame supports two rows of developing, fixing and rinsing chambers and a dryer behind each rinsing chamber. The two rows of chambers are disposed at different levels, one above the other, and the apparatus further comprises discrete pumps for circulating liquids through pairs of developing, fixing and rinsing chambers. A tank is disposed below each and every chamber, and the liquid which overflows from an upper tank enters the respective lower tank which latter has an outlet connected with the inlet of the corresponding pump. The provision of a discrete tank for each chamber and of means for directing overflowing liquid from an upper tank into the corresponding lower tank reduces the likelihood of splashing of liquid which is being returned from the upper tank to the inlet of the associated pump. This is of particular importance in connection with the circulation of developing liquid which should be prevented from coming into contact with surrounding air. However, the numerous tanks contribute to bulk (especially height) and cost of the apparatus.

SUMMARY OF THE INVENTION

An object of the invention is to provide an apparatus which can be utilized for wet treatment of sheets or webs (hereinafter called webs) of photographic material at a rate which is a multiple of the rate of processing in conventional apparatus, and which is more compact than any heretofore known apparatus capable of treating identical quantities of material per unit of time.

Another object of the invention is to provide an apparatus whose dimensions, especially its height, are less than those of the apparatus disclosed in the application Ser. No. 433,444 of Pfeifer et al.

A further object of the invention is to provide an apparatus wherein several series of webs can be processed simultaneously but which need not be equipped with a discrete vessel or tank for each developing, fixing and/or rinsing chamber.

An additional object of the invention is to provide an apparatus which effectively prevents excessive oxidation of liquids used in connection with the treatment of webs of photographic material.

The invention is embodied in an apparatus which is utilized for wet treatment of webs of photographic material and comprises a vessel or tank for a supply of liquid (e.g., a developing, rinsing or fixing bath for exposed photographic films), a conditioning chamber which is disposed above the vessel and defines preferably horizontal upper and lower paths for the movement of webs through the chamber, pairs of rollers or analogous means for advancing webs along the respective paths, means (e.g., a pump and an upright pipe) for conveying liquid from the vessel into the chamber above and below the paths so that the webs which are being advanced through the chamber are contacted by liquid (preferably at both sides) and the liquid is evacuated from the chamber by flowing in and counter to the direction of movement of webs along the respective paths (i.e., the liquid can escape through openings which are provided in the chamber to permit entry and evacuation of webs), and means for returning evacuated liquid into the vessel. The returning means comprises means for intercepting liquid flowing in and counter to the direction of movement of webs along the lower and/or upper path and passages or ducts adjacent to opposite sides of the lower and/or upper path for conveying the intercepted liquid into the vessel, preferably in such a way that the liquid is not allowed to intimately contact the surrounding atmosphere.

The chamber preferably comprises upper, median and lower sections which can form an integral unit. The upper path is defined by the upper and median sections, and the lower path is defined by the median and lower sections. Each section has an inlet which receives liquid from the liquid conveying means, and the rate of liquid flow through the inlet of the median section preferably equals or approximates the combined rate of liquid flow through the other two inlets. This is desirable because the liquid issuing from the inlet of the median section is preferably divided into two separate streams by a suitably oriented partition of the median section; one of the streams contacts the undersides of webs moving along the upper path and the other stream contacts the upper sides of webs moving along the lower path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
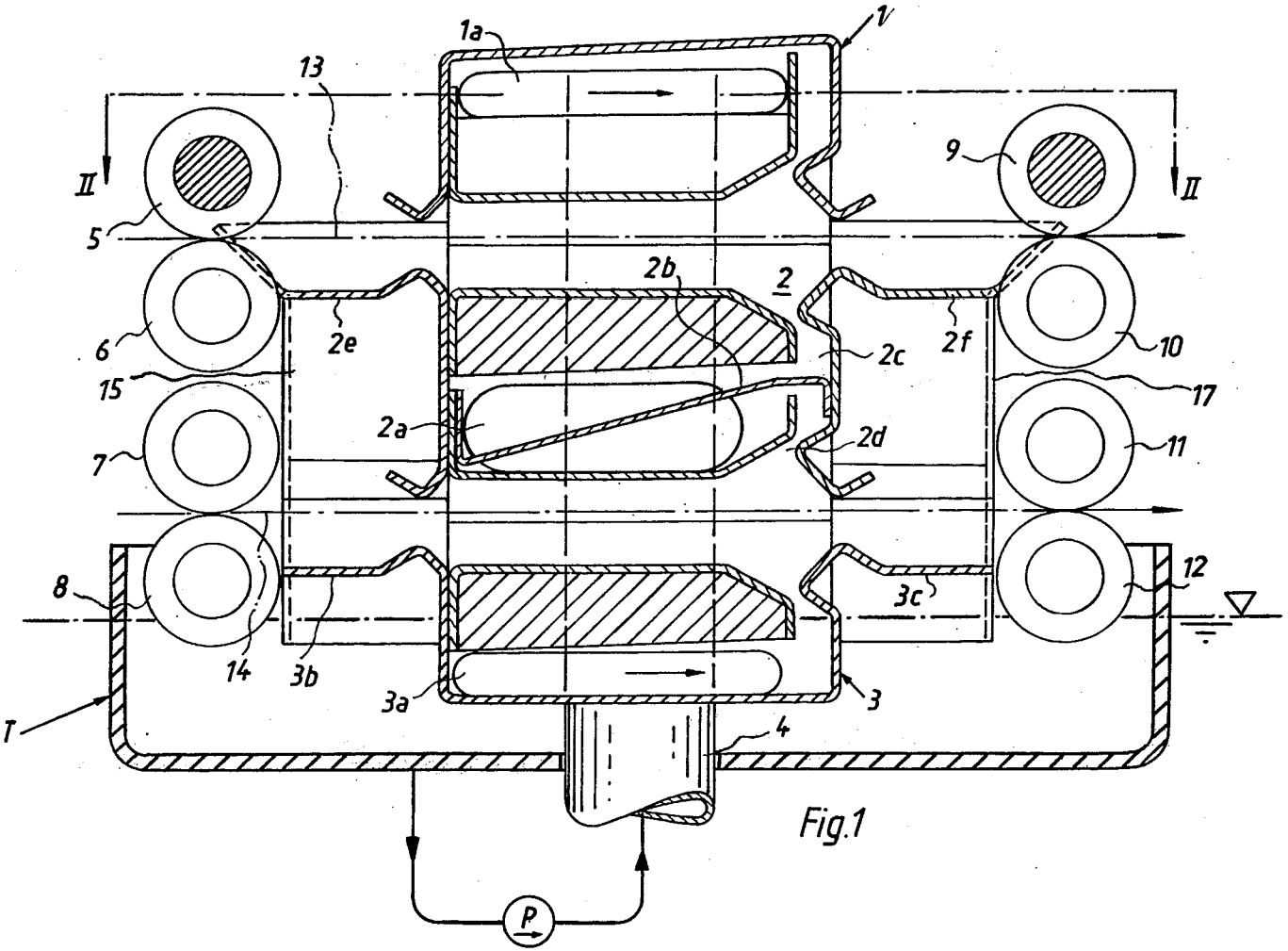
FIG. 1 is a fragmentary schematic longitudinal vertical sectional view of the improved apparatus, substantially as seen in the direction of arrows from the line I—I of FIG. 2.

Referring first to FIG. 1, there is shown a portion of an apparatus for simultaneous processing of two series of webs of photographic material, e.g., webs of exposed photographic film. This apparatus comprises a composite conditioning chamber having an upper section 1, a lower section 3, and an intermediate section 2. The three sections preferably form an integral unit and are mounted on an upright pipe 4 which is connected with the outlet of a pump P and serves to convey a fluid, e.g., a developing liquid, for treatment of webs 13 and 14. The pipe 4 has discharge openings (not specifically shown) which allow liquid flowing from the outlet of the pump P to enter the sections 1, 2 and 3 of the conditioning chamber. The just mentioned discharge openings of the pipe 4 respectively communicate with the inlets 1*a*, 2*a* and 3*a* of the sections 1, 2 and 3.

The conditioning chamber is disposed between advancing rollers 5, 6, 7, 8 and advancing rollers 9, 10, 11, 12. The rollers 5, 6 are located ahead of the chamber and serve to advance successive webs 13 into the chamber intermediate the sections 1, 2; the rollers 9, 10 are located behind the chamber and serve to advance successive webs 13 into the next chamber (e.g., a chamber wherein the webs 13 are contacted with a fixing liquid); the rollers 7, 8 are disposed below the rollers 5, 6 and advance successive webs 14 into the conditioning chamber between the sections 2, 3; and the rollers 11, 12 are disposed below the rollers 9, 10 and serve to advance the webs 14 into the next chamber. The manner in which the rollers 5, 6, 9, 10 and 7, 8, 11, 12, respectively, advance the webs 13, 14 is similar to that disclosed in the aforementioned patent to Frick et al. Thus, and referring to a web 13, such web is advanced into the conditioning chamber by the rollers 5, 6 to be contacted, at both sides, by streams of developing liquid which enter the chamber via inlets 1*a*, 2*a*; the web 13 thereupon leaves the conditioning chamber to enter the nip of the rollers 9, 10 which advance it into the next chamber.

Figure 2:
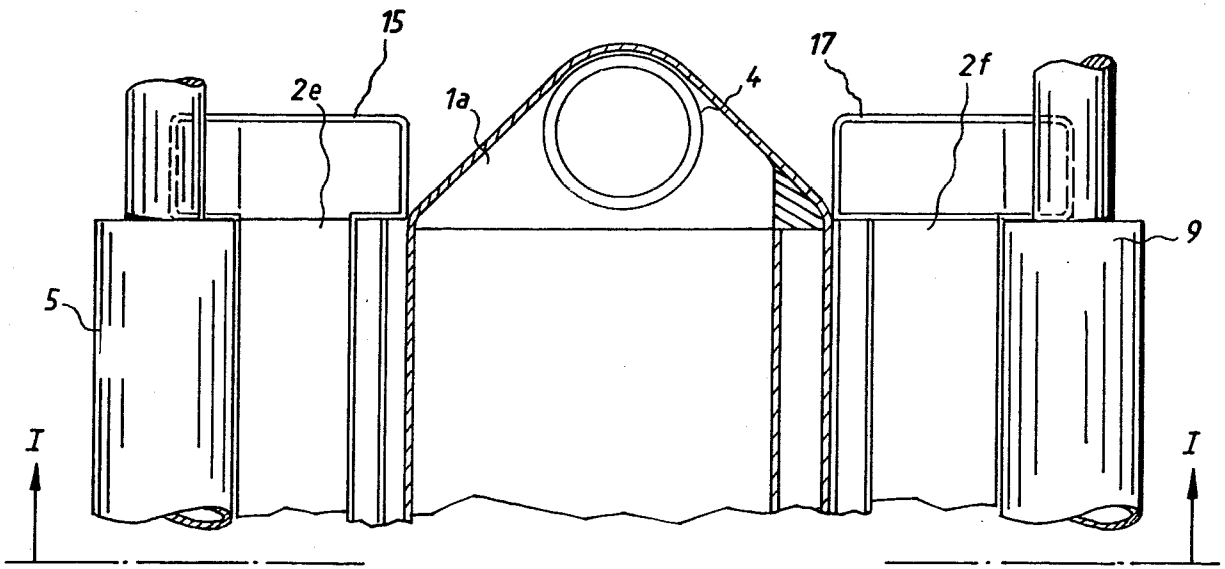
FIG. 2 is a horizontal sectional view substantially as seen in the direction of arrows from the line II—II of FIG. 1.

The cross-sectional area of the inlet 2*a* of the median section 2 increases in a direction away from the respective discharge opening of the pipe 4 so that the inlet 2*a* resembles a funnel (see the inlet 1a in FIG. 2). The inlet 2*a* is located behind a diagonal partition 2*b* which is installed in the section 2 and divides the liquid stream issuing from the inlet 2*a* into two discrete streams one of which contacts the underside of a web 13 in the upper part of the chamber and the other of which contacts the upper side of a web 14 in the lower part of the chamber. The partition 2*b* is inclined forwardly and upwardly, as considered in the direction of travel of webs 13 and 14 along the respective horizontal paths. The upwardly flowing stream of liquid issuing from the inlet 2*a* flows through a channel 2*c* of the section 2 before it enters the space below the path for webs 13, and the downwardly flowing stream of liquid issuing from the inlet 2*a* flows through a channel 2*d* before it reaches the space above the path for webs 14. The inlet 2*a* can feed liquid at a rate which equals or closely approximates the combined rate of liquid flow through the inlets 1*a* and 3*a* because the liquid entering the section 2 via inlet 2*a* must contact a web 13 as well as a web 14.

The section 2 includes a rearwardly extending guide member or intercepting means 2e which intercepts the liquid leaving the sections 1 and 2 counter to the direction of transport of webs 13, and a forwardly extending guide member 2*f* which intercepts the liquid issuing from the sections 1 and 2 in the direction of transport of the webs 13. The lower section 3 has similar guide members or intercepting means 3*b* and 3*c*. The gap between the guide member 2*e* and roller 6 is relatively narrow so that the major part of liquid which is intercepted by the guide member 2*e* overflows laterally to enter a reflux passage or duct 15 adjacent to one side of the path for webs 13 and a similar reflux passage or duct (not specifically shown) at the other side of the path for webs 13. Analogously, the gap between the roller 10 and guide member 2*f* allows for escape of a relatively small quantity of liquid so that the major part of liquid leaving the conditioning chamber between the sections 1 and 2 will overflow laterally of the guide member 2*f*. Some of the overflowing liquid will descend in a passage or duct 17 adjacent to one side of the path for webs 13 and the other part of such overflowing liquid will descend in a similar passage or duct (not shown) adjacent to the other side of the path for webs 13. The ducts 15, 17 and the other two ducts return the overflowing liquid into a tank T which is mounted below the section 3 and from which the pump P draws liquid for introduction into the pipe 4. The ducts at the front end of the chamber further receive liquid which overflows the sides of the guide member 3b, and the ducts at the rear side of the chamber receive liquid which overflows the sides of the guide member 3c. Thus, four ducts (including the illustrated ducts 15 and 17) suffice to return the overflowing developing liquid into the tank T. The ducts reduce the likelihood of contact of developing liquid with the surrounding atmosphere.

The next-following chamber or chambers (e.g., a fixing chamber which immediately follows the chamber having the illustrated sections 1–3 and a rinsing chamber which immediately follows the fixing chamber) are preferably similar to or identical with the chamber of FIGS. 1 and 2.

The tank T may be equipped with suitable means for maintaining the temperature of liquid therein within a predetermined range.

The ducts prevent direct contact between the streams of descending liquid and the surrounding atmosphere. Furthermore, the ducts reduce the likelihood of excessive agitation of liquid in the tank T; this also reduces the possibility of excessive oxidation of liquid in the tank T.

The operation:

Successive webs 13 are fed into the nip of the follers 5, 6, tobe advanced through the chamber in the region between the sections 1 and 2. Webs 14 are advanced along the lower horizontal path, i.e., into the nip of the rollers 7, 8 and through the chamber in the region between the sections 2 and 3. Once the leader of a web 13 reaches the nip of the rollers 9, 10 it is engaged and positively entrained into the next-following chamber. Thus, the rollers 9, 10 can perform the function of rollers 5, 6 insofar as the feeding of sheets 13 into the second chamber is concerned. The transport of webs 14 whose leaders reach the nip of the rollers 11 and 12 is analogous.

As a web 13 advances through the chamber, it is contacted by developing liquid supplied by the inlet 1*a* and the corresponding portion of the inlet 2*a* at such a rate that the web 13 is caused to float in the region between the sections 1 and 2. The liquid flows in and counter in the direction of transport of webs 13 so that it leaves the chamber to be intercepted by the guide members 2*e*, 2*f* and to overflow laterally into the respective ducts including the ducts 15 and 17. The liquid which treats the webs 14 is intercepted by guide members 3*b*, 3*c* and also overflows into the adjacent ducts to be returned into the tank T. Any appreciable direct return flow of liquid into the tank T is effectively prevented due to narrowness of the gaps between the rollers 6, 8, 10, 12 and guide members 2*e*, 3*b*, 2*f*, 3*c*. The pump P draws liquid from the tank T and forces it into the pipe 4 whence the liquid enters the inlets 1*a*, 2*a* and 3*a*.

It will be seen that the possibility of contact between developing liquid and the surrounding atmosphere is practically nil so that the oxidation of such liquid is greatly reduced which results in lower cost for regeneration of developing liquid.

Without further analysis, the foregoing will so fully reveal the gist of the present invention that others can, by applying current knowledge, readiLy adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

1. In an apparatus for wet treatment of webs of photographic material, a combination comprising a vessel for a supply of liquid; a conditioning chamber disposed above said vessel and including vertically spaced upper and lower compartments respectively defining upper and lower paths for the movement of webs of photographic material through said chamber; means for advancing the webs along the respective paths; means for conveying liquid from said vessel into said chamber above and below said paths so that the webs which are being advanced through said chambers are contacted by liquid and the liquid is evacuated from said chamber by flowing in and counter to the direction of movement of webs along said paths; and reflux means for returning evacuated liquid into said vessel, said reflux means including means for intercepting the liquid flowing in and counter to the direction of movement of webs along said upper path and passages adjacent to opposite sides of said upper path for conveying the intercepted liquid into said vessel.

2. The combination of claim 1, wherein said passages extend downwardly along the sides of said lower path.

3. The combination of claim 1, wherein said returning means further comprises means for intercepting the liquid flowing in and counter to the direction of movement of webs along said lower path and for directing the intercepted liquid into said passages.

4. The combination of claim 3, wherein said passages seal the liquid therein from the surrounding atmosphere.

5. The combination of claim 3, wherein said advancing means comprise a pair of rollers disposed ahead of and behind each of said paths.

6. In an apparatus for wet treatment of webs of photographic material, a combination comprising a vessel for a supply of liquid; a conditioning chamber disposed above said vessel and including upper, lower and median sections, said upper and median sections defining an upper path and said median and lower sections defining a lower path for the movement of webs of photographic material through said chamber; means for advancing the webs along the respective paths; means for conveying liquid from said vessel into said chamber above the below said paths so that the webs which are being advanced through said chamber are contacted by liquid and the liquid is evacuated from said chamber by flowing in and counter to the direction of movement of webs along said paths; and reflux means for returning evacuated liquid into said vessel, said reflux means including means for intercepting the liquid flowing in and counter to the direction of movement of webs along said upper path and passages adjacent to opposite sides of said upper path for conveying the intercepted liquid into said vessel.

7. The combination of claim 6, wherein said sections form an integral unit and said liquid conveying means comprises a pipe which supplies liquid to each of said sections.

8. The combination of claim 6, wherein each of said sections has an inlet which receives liquid from said conveying means and said chamber further comprises a partition which divides the liquid issuing from the inlet of said median section into two streams one of which contacts the undersides of webs moving along the said upper path and the other of which contacts the upper sides of webs moving along said lower path.

9. The combination of claim 8, wherein said paths are substantially horizontal and said partition is inclined with respect to said paths.

10. The combination of claim 8, wherein the rate of liquid flow through the inlet of said median section substantially equals the combined rate of liquid flow through the inlets of said upper and lower sections.

* * * * *